United States Patent [19]

Kaminsky et al.

[11] 4,004,890

[45] Jan. 25, 1977

[54] METHOD AND MEANS OF REDUCING EROSION OF COMPONENTS OF PLASMA DEVICES EXPOSED TO HELIUM AND HYDROGEN ISOTOPE RADIATION

[75] Inventors: Manfred S. Kaminsky, Hinsdale; Santosh K. Das, Naperville; Thomas D. Rossing, De Kalb, all of Ill.

[73] Assignee: The United States of America as represented by the United States Energy Research and Development Administration, Washington, D.C.

[22] Filed: Feb. 9, 1976

[21] Appl. No.: 656,214

[52] U.S. Cl. ..... 29/182.3; 29/182; 75/200; 75/208 R; 75/211; 75/224; 228/164; 427/377; 427/372 R; 427/383 C

[51] Int. Cl.[2] ..... B22F 3/00

[58] Field of Search ..... 29/182, 182.2, 182.3; 75/211, 208 R, 206, 224; 427/372, 377, 383; 228/164

[56] References Cited

OTHER PUBLICATIONS

Brumbach et al., X-Ray Impact Induced Desorption of Gases from Surfaces, CONF760209-15, Feb. 1976.

Das et al., Helium Trapping in Al and Sintered Al Powders, CONF750949-9, (1976).

Das et al., Surface Erosion Caused by Helium Blistering: Comparison Between Vacuum Cast and Sintered Be, CONF751125-25, (1976).

*Primary Examiner*—Brooks H. Hunt

*Attorney, Agent, or Firm*—Dean E. Carlson; Arthur A. Churm; Donald P. Reynolds

[57] ABSTRACT

Surfaces of components of plasma devices exposed to radiation by atoms or ions of helium or isotopes of hydrogen can be protected from damage due to blistering by shielding the surfaces with a structure formed by sintering a powder of aluminum or beryllium and its oxide or by coating the surfaces with such a sintered metal powder.

7 Claims, No Drawings

METHOD AND MEANS OF REDUCING EROSION OF COMPONENTS OF PLASMA DEVICES EXPOSED TO HELIUM AND HYDROGEN ISOTOPE RADIATION

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention relates to plasma devices.

It is well known that in plasma devices such as reactors for thermonuclear fusion one problem in the containment of the plasma is the damage resulting from bombardment of exposed surfaces by energetic atoms or ions. Such bombardment causes implantation of atoms especially atoms of helium or of isotopes of hydrogen, in the surfaces of walls or other components exposed to the plasma. The implanted material collects and forms blisters that erode the exposed surface, threatening structural integrity. Broken blisters also produce impurities in the form of particles released from the wall and are ejected into the plasma.

One method of reducing the effects of helium blistering in such structures as the first wall or the diverter of a fusion reactor is to heat the structure to about half its melting temperature. This tends to drive helium out from the surface before it collects to form the large bubbles that result in surface erosion and contamination. However, maintaining such a temperature is likely to be a difficult problem in the components that are to be prevented from blistering, may reduce excessively the strength of these components, and may threaten thermal damage to other nearby components. Also, the chemical corrosion of the component by liquid coolant (e.g. liquid lithium) will be severe at these high temperatures. For example, the temperature needed for materials such as niobium and vanadium is in excess of 1100 K.

Another method of reducing the effects of plasma contamination due to helium blistering is to use materials of low atomic number (low Z). This minimizes the effect of contamination per released atom. However, many low-Z materials cannot be heated sufficiently in their normal forms to the temperatures needed to reduce blistering without losing mechanical and structural integrity.

It is an object of the present invention to provide a better coating for components in the interior of a plasma device.

It is a further object of the present invention to provide a method of minimizing damage due to helium blistering on components inside a fusion reactor.

It is a further object of the present invention to avoid the need for continuous heating of interior walls of a plasma device for the purpose of reduction of surface erosion.

Other objects will become apparent in the course of a detailed description of the invention.

SUMMARY OF THE INVENTION

Structures on the interior of a plasma device that are exposed to bombardment by energetic particles are protected from damage by lining the structures with a sintered powder containing aluminum or beryllium and their respective oxides.

DETAILED DESCRIPTION OF THE INVENTION

Two objectives must be met in the selection of coating or structural materials for surfaces exposed to bombardment by helium or by isotopes of hydrogen in the interior of a fusion reactor. These are to maintain strength of the structure and minimize contamination of the plasma. Both are met by minimizing the amount of material removed from the exposed surface due to bombardment. To minimize the effect of such contamination, it is desirable to use, in coating or structural materials, atoms of atomic number that is as low as possible. Both objectives suggest a search for a material that exhibits a minimum amount of blistering from bombardment by helium. Two materials that meet the requirement of low atomic number Z are beryllium ($Z=4$) and aluminum ($Z=13$). Each of these materials is capable of being sintered together with varying concentrations of its oxide to form a structure adequate to serve as a portion of a reactor lining or a beam limiter.

It is well known that finely-powdered aluminum will oxidize readily upon exposure to air, forming small pellets of aluminum coated with alumina. The relative concentrations are a function of particle size. If such a mixture of aluminum and alumina is formed into a structural shape and sintered or applied as a coating and sintered, the resulting surface has been found to possess a high resistance to helium blistering. Improved resistance to blistering has been obtained with alumina concentrations of 10%–15%. Sintered mixtures of such concentrations are found to develop grains of small average grain size, of the order of 0.5 micrometers, which inhibits the formation of blisters of helium and the resulting structural damage and loss of material to contaminate the plasma.

EXAMPLE I

A sample of finely powdered aluminum was sintered to produce a polycrystalline mixture of aluminum and alumina that contained 10.5% alumina. The sample was polished optically and cleaned by immersion successively in ultrasonically-agitated trichloroethylene, acetone, distilled water, and methanol. This sample was irradiated in comparison with samples of annealed aluminum foil of a purity in excess of 99.99%. The aluminum sample was polished mechanically, cleaned in the same way as the sintered sample, and annealed for 2 hours at a temperature of 573 K (300° C) in a vacuum of the order of 1 to 4 microPascal (10–30 nanoTorr). The samples of aluminum and sintered aluminum powder were then electropolished in a solution of 617 milliliters of phosphoric acid, 134 milliliters of sulfuric acid, 240 milliliters of water and 156 grams of chromium trioxide at a temperature of 340 K. The polished targets were irradiated at room temperature with singly-ionized helium ions at 100 keV to a dose of 1.0 Coulomb per square centimeter. The ions were obtained from a 2-MeV Van de Graaff accelerator, and the target chamber was maintained at a vacuum of the order of 6.5 microPascals (50 nanoTorrs).

The samples were examined in a scanning electron microscope before and after irradiation. Examination of surfaces of polished sintered aluminum powder at magnifications providing resolution finer than 20 nanometers (200 Angstroms) did not reveal any porosity of the surfaces before irradiation. Under examination in the scanning electron microscope samples of polycrystalline aluminum irradiated as described above showed a high degree of blistering that led to large-scale exfoliation and flaking. An erosion rate of aluminum determined from micrographs of irradiated polycrystalline aluminum samples indicated an erosion rate of the order of 1.75 ± 0.25 aluminum atoms removed per incident helium ion. In contrast, the samples of sintered aluminum powder subject to the same irradiation produced small blisters ranging in diameter from 3 to 20 micrometers with a blister density of the order of 800,000 blisters per square centimeter. Very few of the blisters were ruptured and there was no large-scale exfoliation or other removal of material from the surface of the sintered aluminum powder. The erosion rate estimated from scanning electron micrographs is of the order of 0.001 atoms of aluminum removed per incident helium ion.

Beryllium in finely powdered form also forms a readily-sinterable mixture. If powdered beryllium is formed into a structural shape or applied as a coating and sintered in air, the resulting surface of sintered beryllium and beryllia has been found to possess a high resistance to helium blistering.

EXAMPLE II

A sample of beryllium foil that was hot-rolled from a vacuum-cast ingot was compared for resistance to radiation damage with a sample cut from an ingot that was prepared commercially by sintering beryllium powder in air and then hot-rolling the ingot. Both samples were polished mechanically and then electropolished at an applied voltage of 35 volts in an electrolyte containing 100 milliliters of phosphoric acid, 30 milliliters of glycerol, 30 milliliters of ethanol, and 30 milliliters of sulfuric acid. Both targets were irradiated with singly-ionized helium ions at 100 keV to a total dose of 1 Coulomb per square centimeter. This corresponds to a dose of about 6.2 × 10 (exp 18) ions per square centimeter. The observed average grain-size was of the order of 3 micrometers in sintered beryllium and of the order of 5 micrometers in vacuum-cast beryllium. Samples were irradiated at room temperature and at 873 K (600° C). The vacuum-cast beryllium irradiated at room temperature developed blisters ranging in diameter from about 5 micrometers to 35 micrometers. The dosage stated above caused exfoliation of some blisters and signs of erosion. In contrast, the sintered beryllium sample when irradiated at room temperature developed smaller blisters, ranging in diameter from about 5 micrometers to 15 micrometers, and no exfoliation of blisters was observed. All samples except one set were irradiated to 1 Coulomb per square centimeter. The samples of vacuum-cast beryllium foil that were irradiated at 873 K were limited to a dose of 0.5 Coulomb per square centimeter because of the serious blistering and exfoliation that was produced under these conditions. For comparison, a sample of sintered beryllium irradiated at 873 K to a dosage of 1.0 Coulomb per square centimeter produced a smaller number of blisters of smaller average diameter than even the sintered beryllium powder at room temperature. The results of the observations, including a tabulation of erosion yields, are listed in Table I.

TABLE I

Erosion Yields for Be and Al Irradiated with 100 keV $^4He^+$ Ions

TABLE I-continued

| Type of Material | Erosion Yields in atoms/incident ion: Room Temp. (Dose 1.0 C/cm²) | 600° C (Dose 0.5 C/cm²) |
|---|---|---|
| Vacuum-cast Be | 0.001 | 0.3 ± 0.1 |
| Sintered Be | Blisters no exfoliation | 0.02 ± 0.01 (dose 1.0 C/cm²) 400° C (Dose 1.0 C/cm²) |
| Annealed Al | 1.75 ± 0.25 | 0.12 ± 0.05 |
| Sintered Al Powder (SAP) | 0.001 | Blisters no exfoliation |

It can be seen that both sintered beryllium and sintered aluminum powder show a marked increase in resistance to erosion by beams of energetic helium atoms in comparison with the results obtained on samples of the pure metals. Both sintered beryllium and sintered aluminum powder therefore appear well adapted for use in plasma devices in regions subject to radiation by energetic ions of helium or isotopes of hydrogen.

An example of an application for which the coating or composition of the present application is useful is afforded in application Ser. No. 598,101, filed by one of the applicants herein, which is incorporated by reference into the present application as though set forth fully therein. That case discloses a beam limiter for thermonuclear fusion devices. The beam limiter is placed close to a beam of an ionized gas comprising a plasma. It is a matter of design choice whether the beam limiter or any other component exposed to a plasma is given the coating of the present invention by sintering a powder in place on an existing structure or whether the composition of matter is sintered into the desired structural shape.

The embodiments of the invention in which an exclusive property or privilege is claimed are defined as follows:

1. A coating for surfaces of plasma devices exposed to radiation of atoms and ions of helium and isotopes of hydrogen comprising a sintered powder of a metal and an oxide of the metal, the metal selected from the group consisting of aluminum and beryllium.

2. The coating of claim 1 wherein the mixture contains 85–90% metal and 15–10% oxide by weight.

3. A method of reducing erosion from a surface exposed to particle radiations of helium or isotopes of hydrogen comprising the steps of:

coating the surface with a powder of a metal selected from the group consisting of aluminum and beryllium; and sintering the coated surface in a gas mixture containing oxygen to form a sintered mixture of the metal and its oxide.

4. The method of claim 3 wherein the sintered mixture contains 85–90% metal and 15–10% oxide by weight.

5. A method of protecting a surface of a plasma device, which surface is exposed to radiation from atoms and ions of helium and isotopes of hydrogen, the method comprising the steps of:

forming of powdered metal and its oxide a structural shape to fit the surface, the metal selected from the group consisting of aluminum and beryllium;

sintering the structural shape in a gas mixture containing oxygen to form a sintered liner;

disposing the sintered liner on the surface in the plasma device, whereby the surface is protected from the radiation.

6. The method of claim 5 wherein the weight ratio of powdered metal to oxide is in the range 85:15 to 90:10.

7. In a plasma containment device the improvement wherein the surfaces of said device that are exposed to radiation by atoms or ions of helium or isotopes of hydrogen are formed of a sintered powder of a metal and its oxide, the metal selected from the group consisting of aluminum and beryllium.

* * * * *